US008985328B2

(12) United States Patent
Slaats

(10) Patent No.: US 8,985,328 B2
(45) Date of Patent: Mar. 24, 2015

(54) MOBILE PLATFORM AND SYSTEM AND METHOD OF USING SAME

(75) Inventor: Matthew J. Slaats, Neenah, WI (US)

(73) Assignee: Menasha Corporation, Neenah, WI (US)

( * ) Notice: Subject to any disclaimer, the term of this patent is extended or adjusted under 35 U.S.C. 154(b) by 1106 days.

(21) Appl. No.: 11/674,524

(22) Filed: Feb. 13, 2007

(65) Prior Publication Data

US 2007/0193479 A1 Aug. 23, 2007

Related U.S. Application Data

(60) Provisional application No. 60/773,088, filed on Feb. 14, 2006.

(51) Int. Cl.

| | |
|---|---|
| ***B65D 19/00*** | (2006.01) |
| ***A47F 5/00*** | (2006.01) |
| ***B65D 19/04*** | (2006.01) |

(52) U.S. Cl.

CPC ..... *A47F 5/0018* (2013.01); *B65D 19/04* (2013.01); *B65D 2519/00034* (2013.01); *B65D 2519/00069* (2013.01); *B65D 2519/00268* (2013.01); *B65D 2519/00308* (2013.01); *B65D 2519/00333* (2013.01); *B65D 2519/00348* (2013.01); *B65D 2519/00407* (2013.01); *B65D 2519/00497* (2013.01); *B65D 2519/00621* (2013.01); *B65D 2519/00666* (2013.01); *B65D 2519/00781* (2013.01)

USPC ..... 206/386; 108/51.11

(58) Field of Classification Search

USPC ..... 206/386, 600, 499, 320, 736, 599, 598, 206/595, 596, 597; 108/53.1, 901, 56.3, 108/55.3, 53.5, 55.1, 176–178, 186–189, 108/57.28, 57.15, 57.29, 55, 57.25, 57.27, 108/57.34, 52.1, 57.17, 57.19, 57.21, 57.2, 108/57.22, 57.33, 160, 51.11, 57.12; 280/79.2, 79.4, 79.11

See application file for complete search history.

(56) References Cited

U.S. PATENT DOCUMENTS

| | | | | | |
|---|---|---|---|---|---|
| 1,608,039 | A | * | 11/1926 | Romine | 108/51.11 |
| 1,912,847 | A | * | 6/1933 | Klepel | 206/503 |
| 1,993,237 | A | * | 3/1935 | Barrett | 108/57.23 |
| 2,738,940 | A | * | 3/1956 | Coit, Jr. | 108/53.5 |
| 3,198,328 | A | * | 8/1965 | Donahue et al. | 206/526 |
| 3,233,564 | A | * | 2/1966 | Sullivan | 108/53.1 |
| 3,480,196 | A | * | 11/1969 | Simas | 206/598 |
| 3,528,676 | A | * | 9/1970 | Marcandalli | 280/79.2 |
| 3,533,502 | A | * | 10/1970 | Hansen | 206/386 |
| 3,730,417 | A | * | 5/1973 | Lawson | 206/598 |

(Continued)

*Primary Examiner* — Jacob K Ackun
*Assistant Examiner* — Jenine Pagan
(74) *Attorney, Agent, or Firm* — Nixon Peabody LLP

(57) ABSTRACT

An assembly (10) is disclosed having a pallet or mobile platform (20), restraining blocks (90), a pallet tray (70) and a cover (60) for supporting, transporting, and displaying goods. The goods, preferably in displays or stacking trays (70) are supported on the pallet's base (21). The pallet (20) includes removable wheels or casters (36) and two parallel rails or guides (33) projecting from the bottom surface (26) and a perimeter wall (22, 23) projecting from the upper surface (25). To the extent a forklift is used, the guides (33) provide a side-exposed space or opening between the wheels (36) permitting insertion of the forklift tines. The cover (60) and pallet tray (70) include side openings (63, 73) to align with the space or openings below the pallet (20) base (21) and between the guides (33) so that forklifts and their tines may be used with the covered assembly (10).

6 Claims, 12 Drawing Sheets

(56) References Cited

U.S. PATENT DOCUMENTS

| | | | | | |
|---|---|---|---|---|---|
| 3,879,053 | A | * | 4/1975 | Chvala | 280/6.15 |
| 3,910,204 | A | * | 10/1975 | Jesse | 108/55.5 |
| 4,085,847 | A | * | 4/1978 | Jacalone | 206/600 |
| 4,171,741 | A | * | 10/1979 | Fish | 206/335 |
| 4,503,973 | A | * | 3/1985 | Andersson | 206/386 |
| 4,852,756 | A | * | 8/1989 | Holladay | 206/335 |
| 4,877,137 | A | * | 10/1989 | Govang et al. | 206/597 |
| 5,176,265 | A | * | 1/1993 | Bennett | 211/85.18 |
| 5,186,330 | A | * | 2/1993 | McClure | 206/508 |
| 5,465,672 | A | * | 11/1995 | Boyse et al. | 108/51.3 |
| 5,540,536 | A | * | 7/1996 | Hoedl | 414/416.09 |
| 5,566,961 | A | * | 10/1996 | Snell et al. | 280/47.35 |
| 5,918,744 | A | * | 7/1999 | Bringard et al. | 206/596 |
| 5,980,008 | A | * | 11/1999 | Stoever | 312/351.12 |
| 6,070,726 | A | * | 6/2000 | Graham | 206/386 |
| 6,113,203 | A | * | 9/2000 | Chen | 312/258 |
| 6,126,131 | A | * | 10/2000 | Tietz | 248/346.01 |
| D453,057 | S | * | 1/2002 | Sewell | D34/38 |
| 6,769,368 | B2 | * | 8/2004 | Underbrink et al. | 108/55.3 |
| 2002/0153682 | A1 | * | 10/2002 | Gruber | 280/79.11 |
| 2004/0195195 | A1 | * | 10/2004 | Mason | 211/134 |
| 2005/0116433 | A1 | * | 6/2005 | Mallan | 280/79.2 |

* cited by examiner

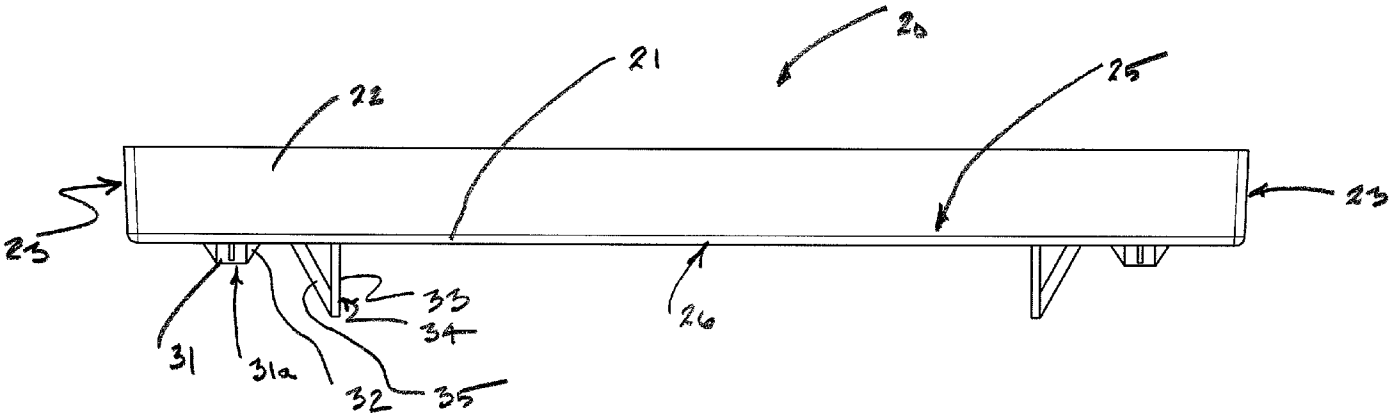
FIG. 4
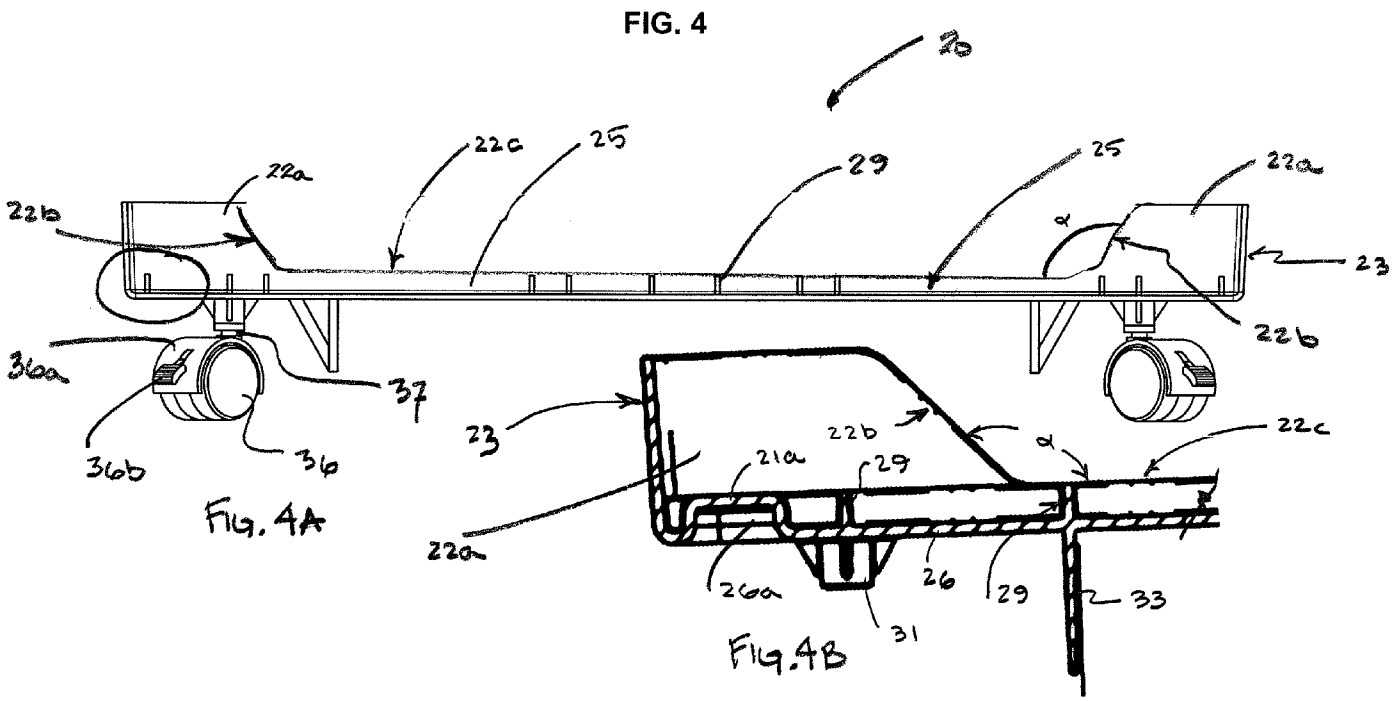
Fig. 4B
Fig. 4A

MOBILE PLATFORM AND SYSTEM AND METHOD OF USING SAME

CROSS REFERENCE TO RELATED APPLICATIONS

This Application claims priority on U.S. Provisional Application No. 60/773,088 filed on Feb. 14, 2006, which is herein incorporated by reference.

TECHNICAL FIELD

The present invention relates to pallets, and more particularly, to a mobile platform having wheels, for transporting, storing and displaying goods thereon.

BACKGROUND OF THE INVENTION

Pallets are commonly used for transporting and storing goods. They are made and used in many different sizes and out of many different materials. At one time, pallets were made of wood. Today, pallets are not only made from wood, but also corrugated materials and plastics. Plastic pallets have the benefits of being more durable and having a longer life.

A common or typical scenario is as follows: At a distribution center, items meant for a particular, remote location, such as a store, are placed and secured on a pallet. The pallet and the palletized goods thereon are transported to the desired location by truck, train, boat or plane. Next, the items are either removed from the pallet and put on display or placed in inventory (a separate room, facility or location) or kept on the pallet and kept in inventory until needed. Eventually, the items are removed from the pallet and put on display for consumers to review, remove and purchase.

Rarely are items maintained on a pallet while the items are on display. The reasons are many. One such reason is the pallets can be unsightly. Another reason is the mere size of the pallets. Typical pallets are too large to move into and out of stores through doorways, into and out of freezers within a store, and up and down aisles. In addition, pallets with goods thereon can be relatively heavy, so moving them without a forklift can be difficult or impossible. Accordingly, there is a need for ain improved system whereby goods can be transported, stored, if necessary, and displayed.

SUMMARY OF THE INVENTION

The present development satisfies the above need, as well as others, and is an improvement upon existing pallet systems. The present invention is a mobile platform, and more particularly, a smaller pallet. It is nominally a quarter pallet having removable wheels or casters and two rails or guides projecting from the bottom surface of the base of the pallet. The upper surface of the base includes a perimeter wall. Individual product displays, or stacking trays, with products therein can be stacked on the pallet and displayed thereon in stores. The stacking trays do not need to be removed from the pallet before displaying them. Because of the size of the pallet and the trays thereon, the pallet with the displays can be readily and more easily moved into and out of stores and around a store, such as up and down aisle, into and out of the warehouse or inventory area and into and out of walk-in freezers/refrigerators. To the extent a forklift is used, the guides projecting downwardly from the bottom the surface of the pallet provide a side-exposed space or opening between the wheels for permitting insertion of the forklift tines. The parallel rails both guide the forklift tines under the pallet, acting as bumpers, and protect the wheels.

For transporting goods, one first puts down on the ground or other supporting surface a separate pallet tray and blocks. The pallet described above can then be placed on or in the separate pallet tray with the blocks positioned between the wheels. Next, goods in individual display/stacking trays are stacked on the pallet and the assembly covered with a shroud or cover. The cover and pallet tray include side openings to align with the space or side openings below the pallet base and between the guides so that forklifts and their tines may be used with the entire shrouded assembly.

Other advantages and aspects of the present invention will become apparent upon reading the following description of the drawings and the detailed description of the invention.

BRIEF DESCRIPTION OF THE DRAWINGS

To understand the present invention, it will now be described by way of example, with reference to the accompanying drawings in which:

FIG. 4 and FIG. 4A are side elevation views of the pallet without and with wheels/casters, respectively, with FIG. 4B showing another embodiment of the side wall;

DETAILED DESCRIPTION OF THE INVENTION

Figure 1:
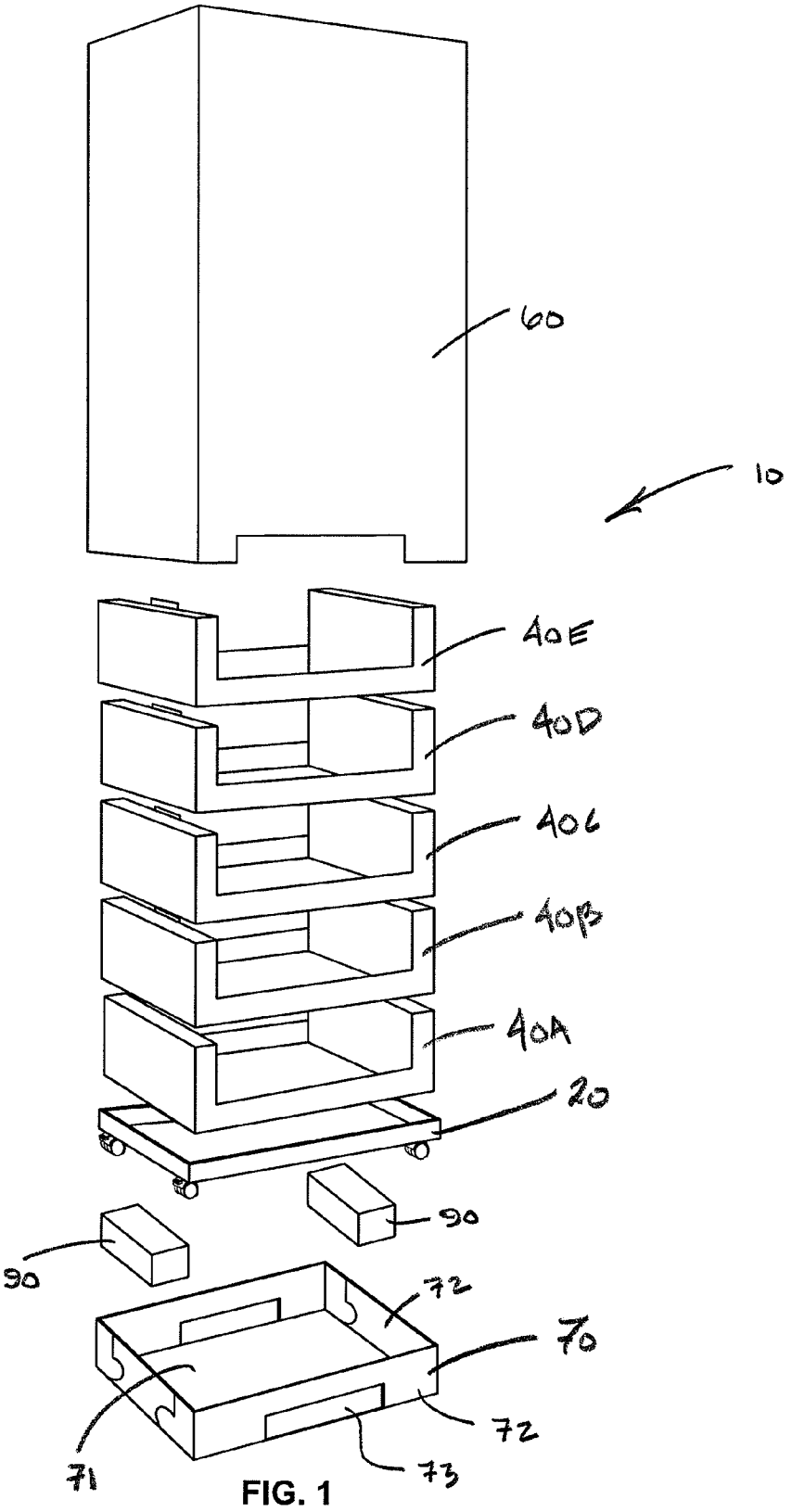
FIG. 1 is a perspective exploded view of the assembly made in accordance with the teachings of the present invention and showing the various components of the assembly.
Figure 2:
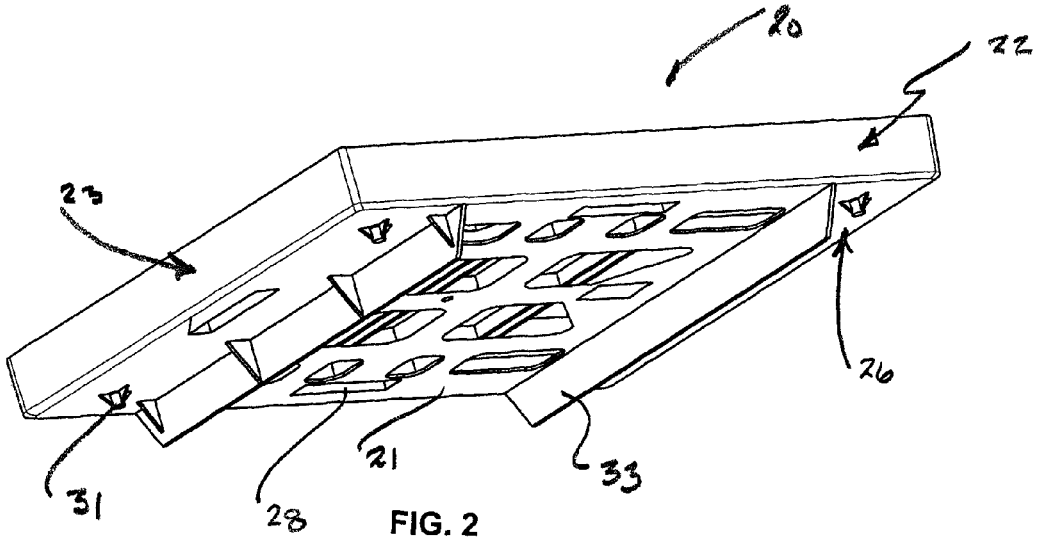
FIG. 2 is a perspective side view of the pallet or mobile platform made according to the teachings of the present invention.
Figure 3:
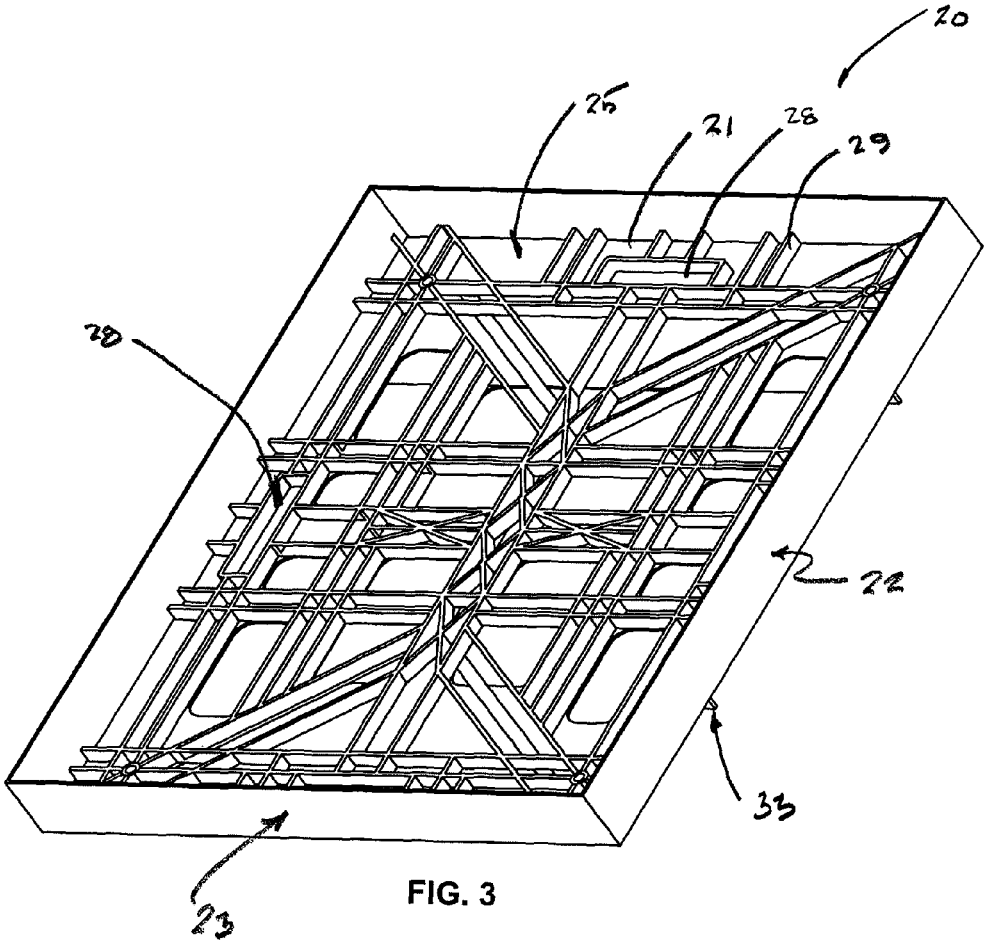
FIG. 3 is a top perspective view of the pallet of FIG. 2.
Figure 5:
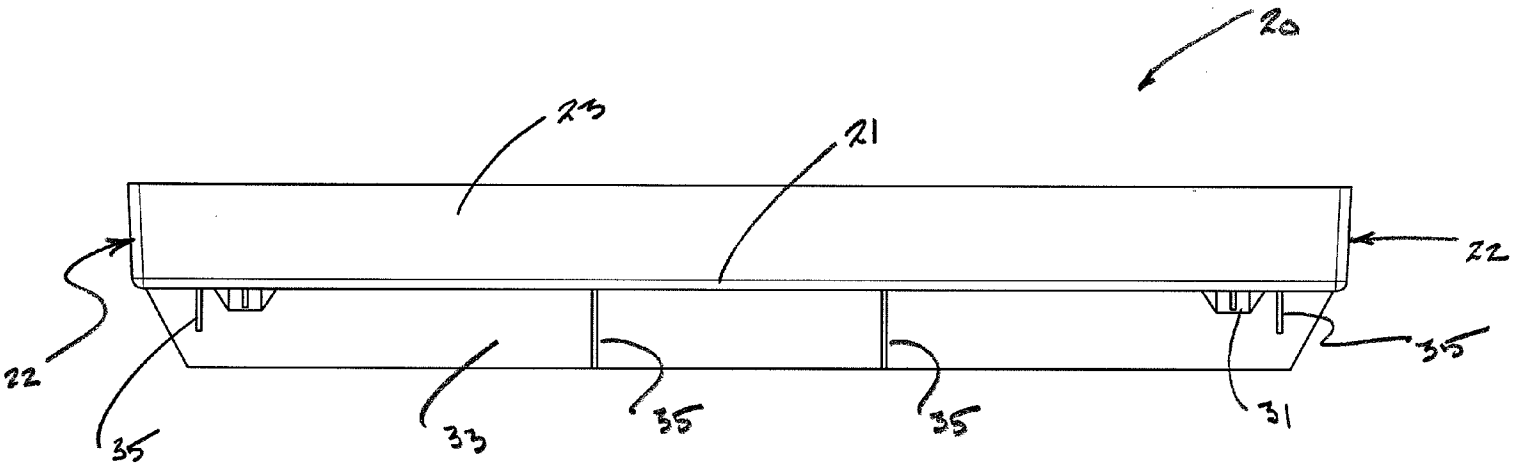
FIG. 5 and FIG. 5A are end elevation views of the pallet without and with wheels/casters, respectively.
Figure 5A:
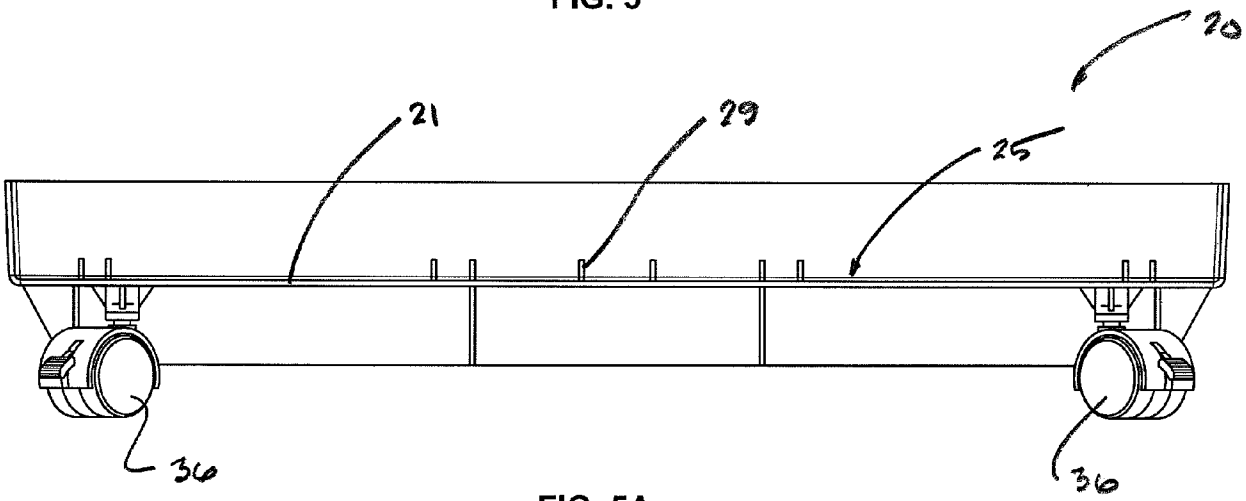
Figure 6:
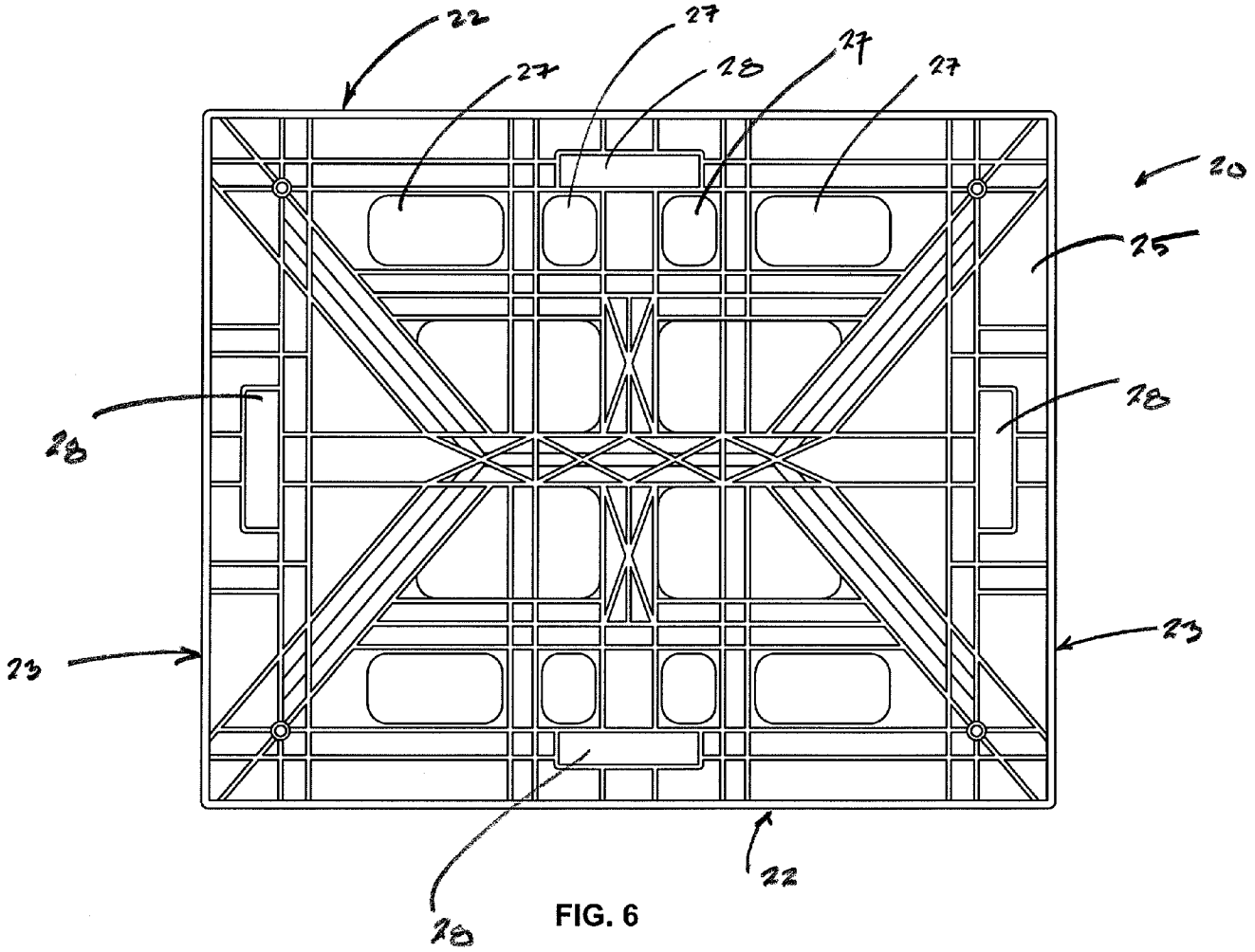
FIG. 6 is a top plan view of the pallet.

While this invention is susceptible of embodiments in many different forms, there is shown in the drawings and will herein be described in detail, preferred embodiments of the invention with the understanding the present disclosure is to be considered as an exemplification of the principles of the invention and is not intended to limit the broad aspect of the invention to the embodiments illustrated. The present invention will have the following main components and techniques for operation of the device.

As shown in FIG. 1, the assembly 10 includes a pallet, or mobile platform 20 having a base 21 with an upper surface 25 supporting one or more display/stacking trays 40A-40E. A perimeter wall (opposed end walls 23 and opposed side walls 22) extends upwardly from the upper surface 25 of the base 21 to hold (and prevent sliding) the display/stacking trays 40 therebetween. The display/stacking trays (Display 40A-Display 40E) are typical of those used in the industry for displaying and holding goods for consumers. Generally, such display/stacking trays 40 are put on store shelves separately or stacked one on top of another on the store shelves and adjacent shelves. When the uppermost display/stacking tray is emptied, the display/stacking tray itself is removed and thrown out or recycled and the display/stacking tray below it is then exposed and displayed. Here the display/stacking trays are shown one on top of another. The footprint of each display/stacking tray comfortably sits on the pallet base 21 within the confronting perimeter walls 22, 23.

The nominal size of the pallet 20, or its footprint or outer dimension, is that of a quarter pallet. Specifically, pallets are typically 40" by 48". The pallet of the present invention is nominally 20" by 24". Its footprint is slightly smaller (specifically, 19.015" by 22.640") so that the total size of the assembly, with the cover 60 around and over the pallet 20 and the pallet tray 70, has an overall footprint, or outer diameter, of approximately 20" by 24".

The bottom surface 26 of the pallet base 21 includes bosses 31 in or adjacent each of the four (4) pallet corners for supporting removable wheels or casters 36. Each boss 31 includes an opening therein 31*a* and radially spoking support flanges 32. Well known wheels or casters 36 in the market may be snapped into and out of the bosses 31 when needed or when being replaced. Typical casters support wheels 36 on posts 37. The wheels 36 can further include a cover 36*a* and a locking mechanism 36*b* to prevent wheel rotation when it is unwanted. The posts 37 snap into and out of the openings 31*a* in the bosses 31 provided. Each boss' support flanges 32 radially project outwardly from the boss 31 and extend from and along the bottom surface 26 of the base 21 to reinforce the boss.

The bottom surface 26 further includes two parallel rails or guides 33 projecting therefrom. These guides 33 are substantially parallel to the end walls 23. The confronting surfaces 34 of the guides 33 are generally smooth and the other surfaces (the outwardly facing surfaces) are reinforced with a plurality of parallel reinforcement ribs, flanges, or gussets 35 normal thereto (and extending from and along the bottom surface 26 of the base 21) to reinforce the guides 33. In an alternative embodiment, the support flanges 35 are not used to support the guides 33 to the bottom surface 26.

The confronting guide surfaces 34 are preferably spaced about 14.25" apart and have a height of about 1". Forklift tines (not shown) are typically about 5" wide each. When the tines are brought together, substantially adjacent one another, their side-by-side width is around 10" to 13". Consequently, the 14.25" distance between the confronting guide surfaces 34 is recognized as a safe general cross-dimension of forklift tines when the tines are brought together. As a result, a forklift operator can move the tines of the forklift together and move the tines into the space provided at the side of the pallet, below the base, between the guides. The forklift can then lift the pallet 20, or the entire assembly 10 (pallet 20, pallet tray 70, display/stacking trays 40 and cover 60) with the forklift. The guides 33 acting as bumpers guide the forklift tines into the space between the guides and through the space under the pallet base 21.

The guides/rails 33 also protect the casters/wheels 36 from the forklift tines. The guides prevent the tines from hitting the wheels/casters once the tines are introduced or inserted into the space between the guides 33. It should be noted that when the wheels 36 are attached to the platform, the wheels descend beyond and below the lowest point, or distal end, of the guides 33. As a result, the wheels contact the ground or support surface when the platform is positioned on the ground or support surface. This permits one to roll the platform/tray 20, with all it is supporting, around a storage or transport facility and at the location of use, such as a store.

The base 21 of the pallet further includes elongated hand slots (openings) 28 running adjacent and parallel to the perimeter walls 22, 23. These slots 28 permit an individual to more easily pick-up and carry the pallets 20. The slots 28 are specifically sized to permit a hand to partially pass therethrough to grip the base and carry the pallet. Each slot is about 4" long and about 1.12" wide.

FIGS. 2-10 generally show the construction of the mobile platform 20 of the present invention. Additional openings 27 (wherein there is no material or material has been removed) are provided to reduce the overall weight of the platform. Support ribs 29 are also provided to add strength to the platform. The support ribs 29 project outwardly from the top surface 25 of the base surface 21. As noted in the figures, the support ribs are strategically located/positioned to provide maximum support and strength to the platform and prevent bowing and breaking. It should be noted that the ribs can project from the bottom surface 26 instead of or in addition to the ribs projecting from the top surface 25. In the preferred embodiment, the support ribs project from the top surface so that the bottom surface may be kept or maintained smooth. A smooth bottom surface minimizes the potential for the fork lift tines to get caught on a rib as it passes through the under the pallet.

FIGS. 4A and 4B show an additional embodiment of the side walls 22*a* for the pallet 20. In the alternative embodiment, the side walls 22*a* are reduced in size. In particular, adjacent the end walls 23, the side walls 22*a* are at fall height. They then are angled 22*b* towards the top surface 25 of the bottom surface 21 until about the height of the ribs 29 (see wall portion 22*c*). The angle $\alpha$ is about 135 degrees. In addition, as shown in FIG, 4B, the bottom surface 21*a* can have a perimeter channel 26*a* constructed therein adjacent and parallel all of the walls 22, 23 or just the side walls 22 or end walls 23.

Figures 8, 8A, 8B, 8C:
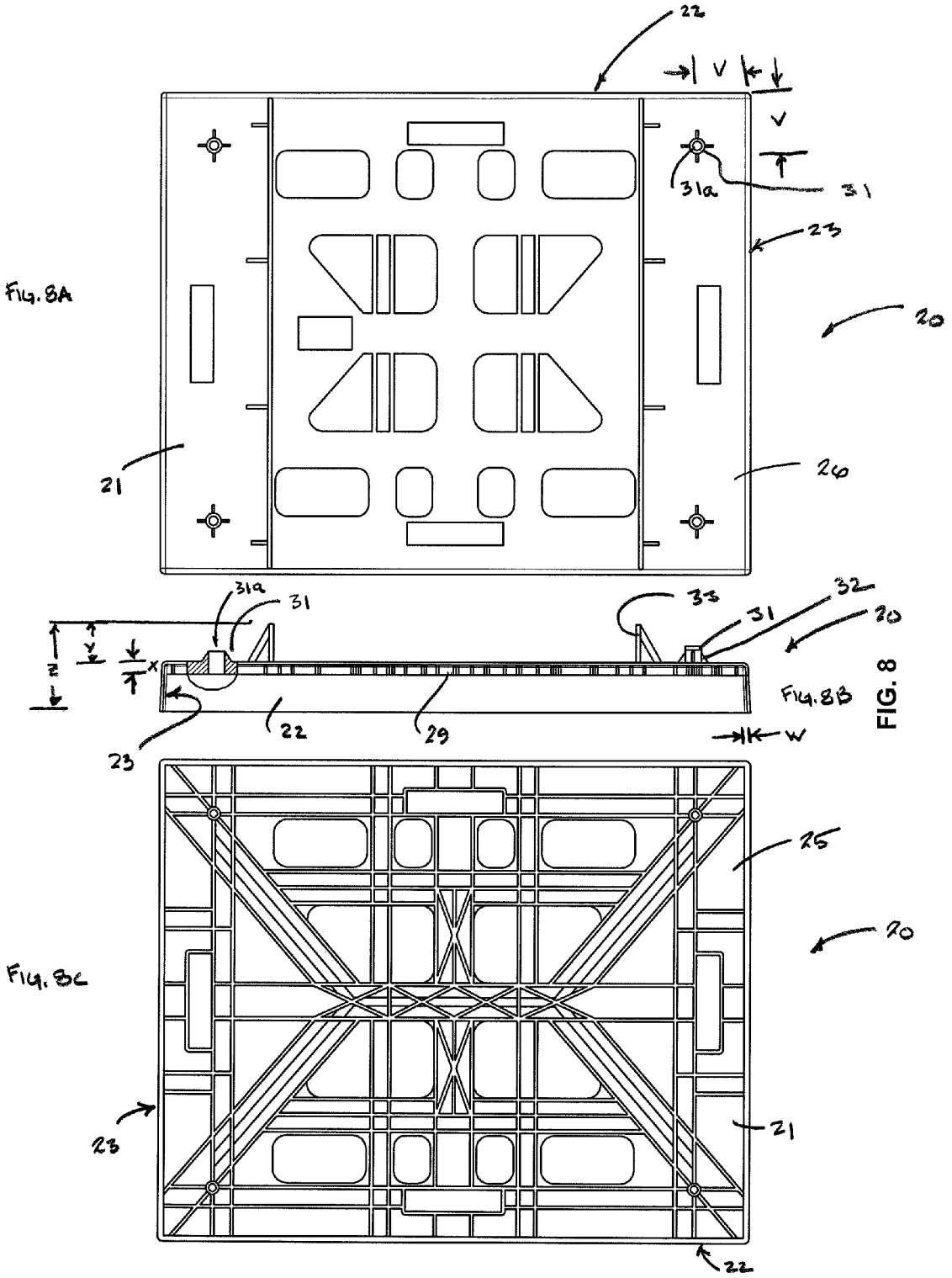
FIG. 8 comprised of FIGS. 8A, 8B and 8C are bottom plan, side sectional, and top plan views of the pallet including dimension leaders.
Figure 9:
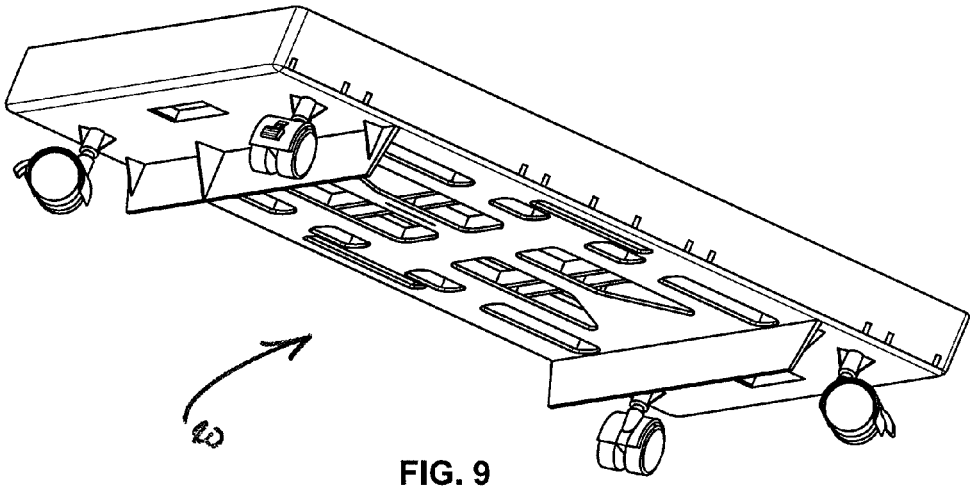
FIG. 9 is a perspective bottom view of the pallet with wheels/casters.
Figure 10:
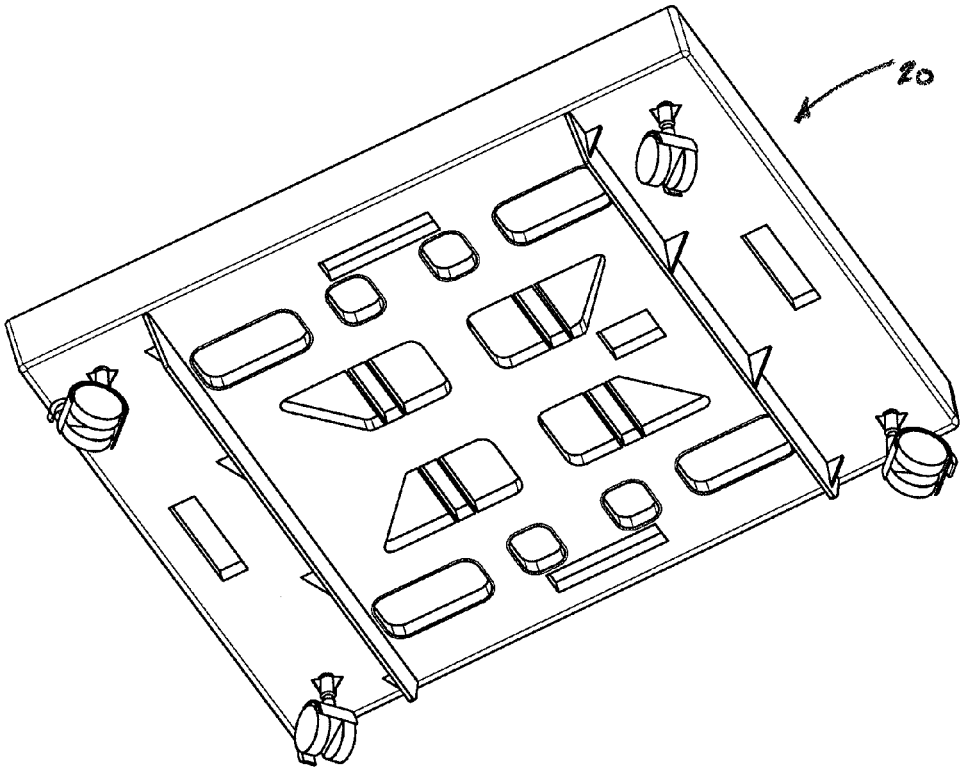
FIG. 10 is another perspective bottom view of the pallet with wheels/casters.
Figure 11:
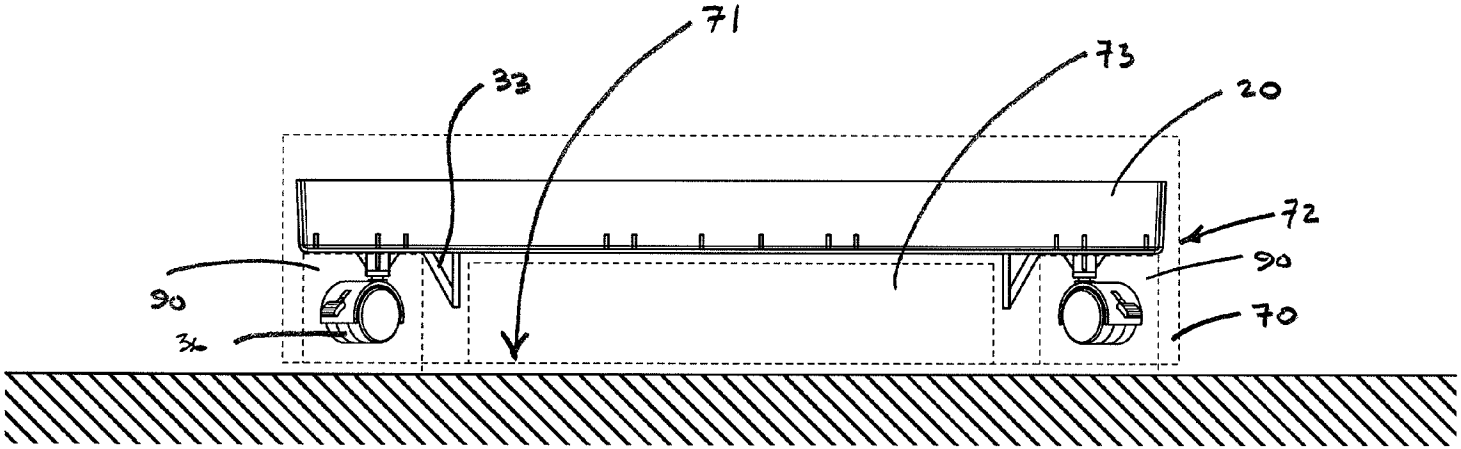
FIG. 11 is a side view showing placement of the pallet with respect to the blocks and pallet tray while preparing the entire assembly for transportation.

As shown in FIG. 8B, the walls 22, 23 of the pallet 20 (dimension W) are about 0.35" thick, with the ribs 29 and base 21 (dimension X) totalling about 0.50". Accordingly, with the guide 33 (dimension Y) being about 1.5", the overall height of the pallet 20, without casters/wheels 36, (dimension Z) is approximately 3.5". The openings 31*a* for each boss 31 are positioned (dimension V) about 2.069" from each edges of the walls 22, 23.

Figure 7:
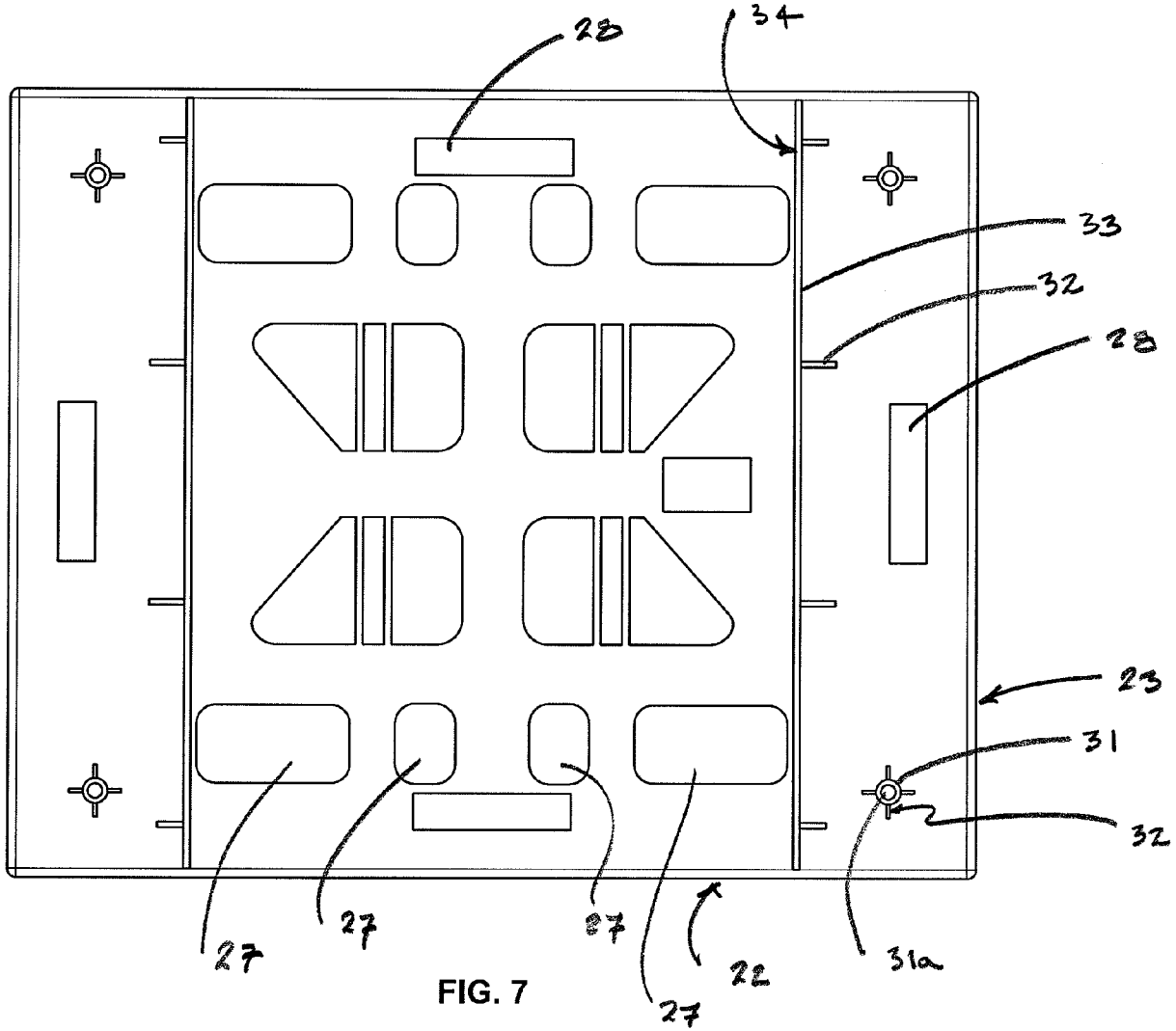
FIG. 7 and FIG. 7A are bottom plan views of the pallet without and with wheels/casters, respectively, with FIG. 7A showing the bottom of the pallet being transparent so as to see the support ribs on the top surface.
Figure 7A:
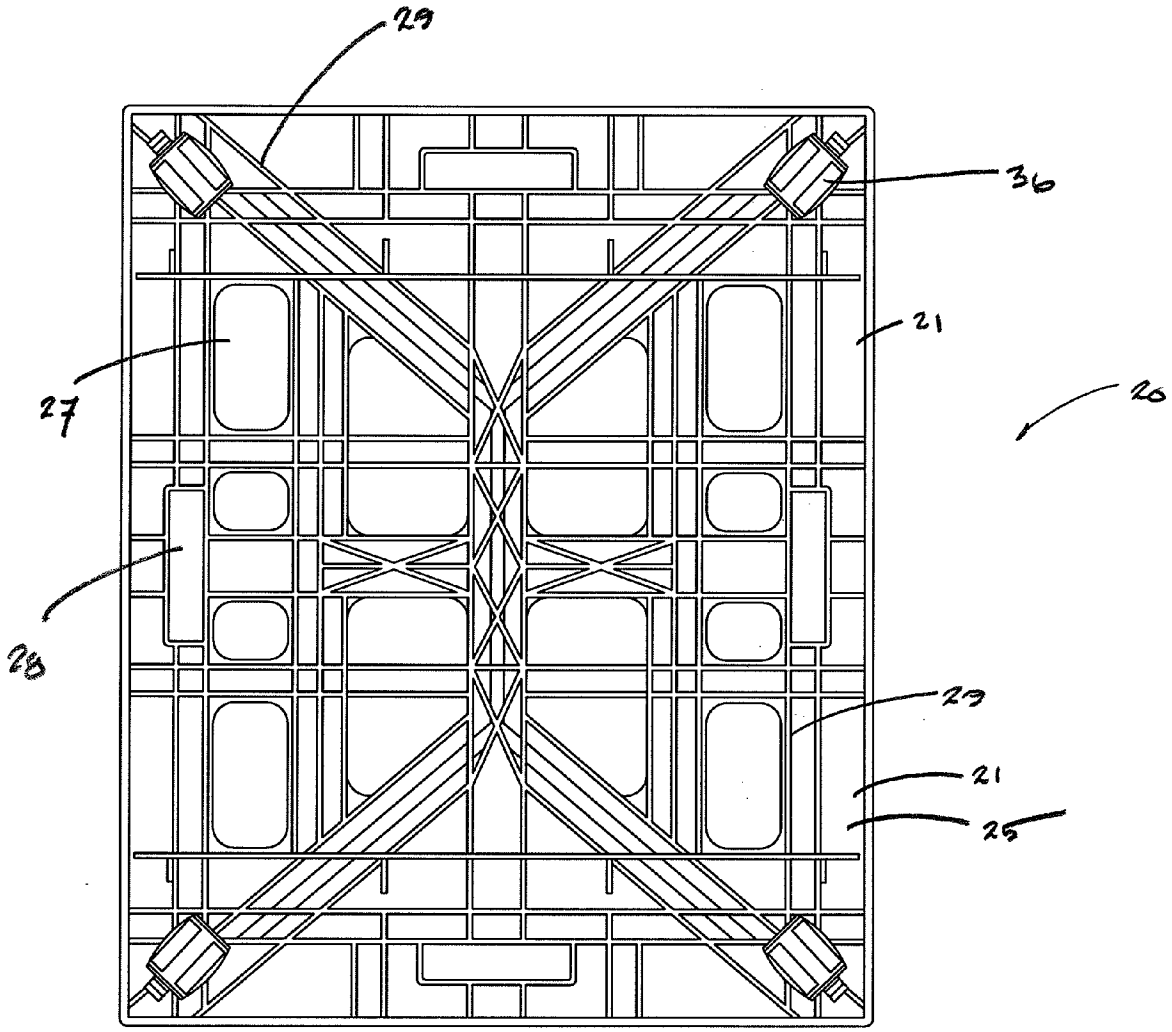

FIG. 7*a* shows the bottom surface of the base 21 as though it were transparent so that one can see the orientations of the support ribs 29 projecting from the top surface 25. In an alternative embodiment (not shown) the ribs 29 do not extend all the way to the walls 22, 23. Rather, the ribs 29 extend to a location spaced from the walls 22, 23 resulting in a smooth, perimeter flat upper surface 25 adjacent all of the walls 22, 23. In short, a smooth margin is provided adjacent the walls void of ribs 29. See FIG.4B.

FIGS. 11-14 generally show other components of the assembly 10 and assist in understanding the steps to putting the entire assembly of the present invention together with the pallet 20 of the present invention. A pallet tray 70 is first put down on the ground. The pallet tray 70 is a tray with a bottom surface 71 and upwardly extending side walls 72 with side openings 73 therein. The pallet tray is preferably made of polypropylene (plastic), but can be made of other materials. For example it may be made of corrugated materials so as to be easily foldable or removable. Note for illustrative purposes a gap is shown between the ground/support surface and the bottom 71 of the tray 70, in reality there is no gap.

Figure 12:
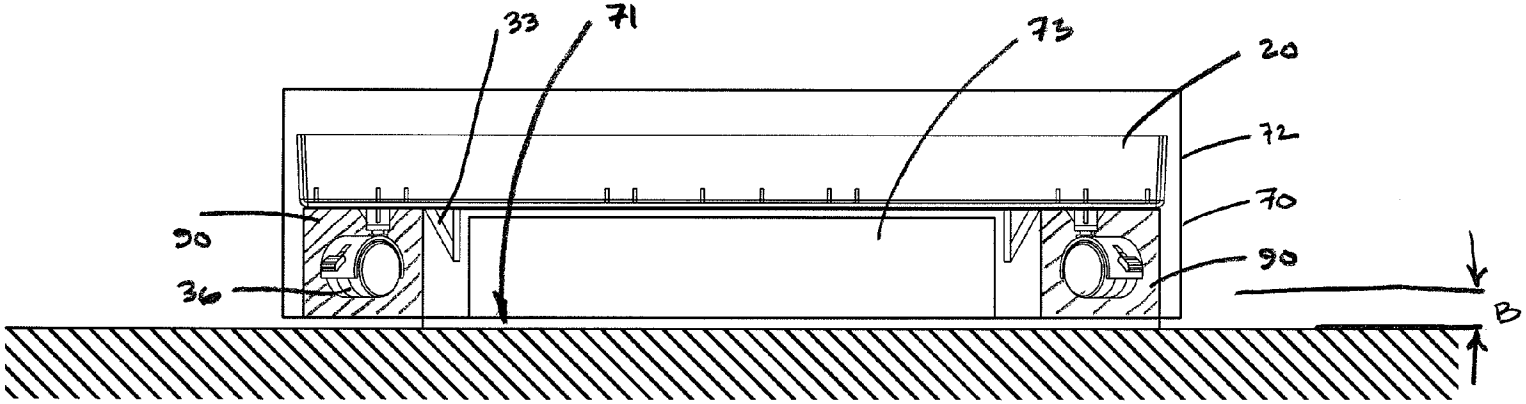
FIG. 12 is the same view as FIG. 11 with the pallet tray shaded.
Figure 13:
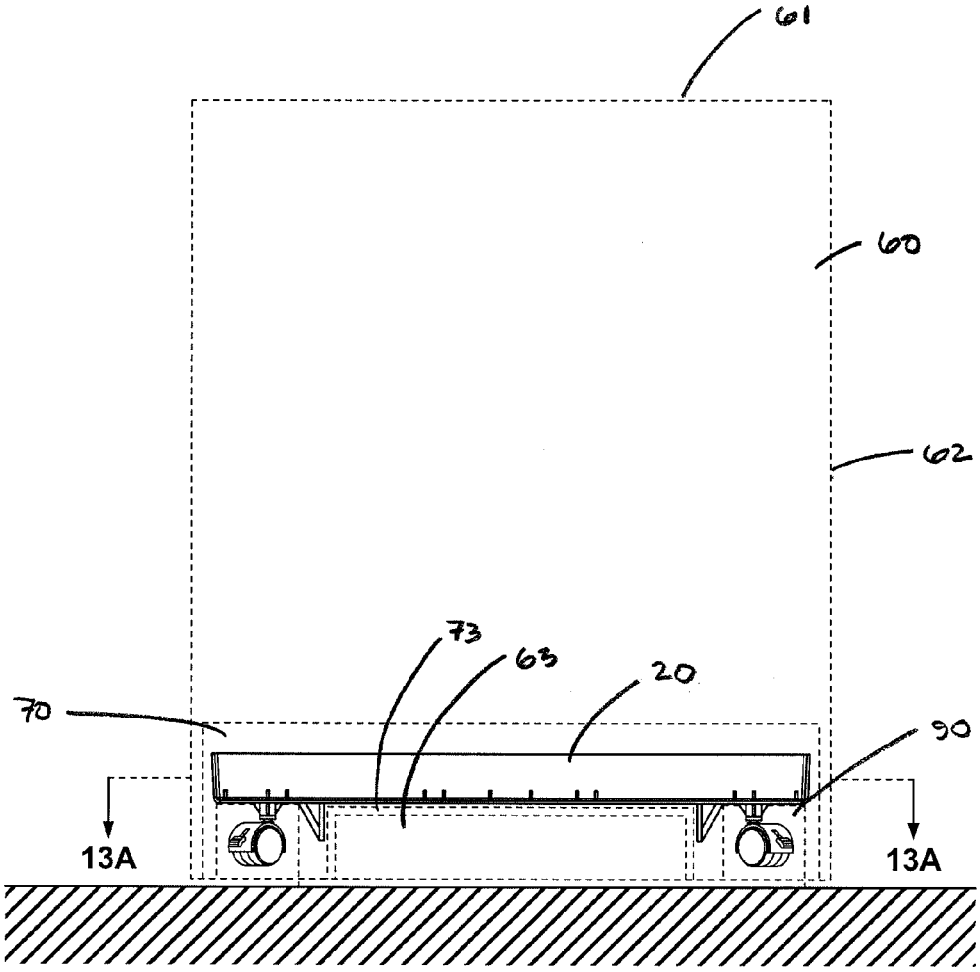
FIG. 13 is a side view showing placement of the cover or shroud over and around the pallet, pallet tray and blocks while preparing the entire assembly for transportation.
Figure 13A:
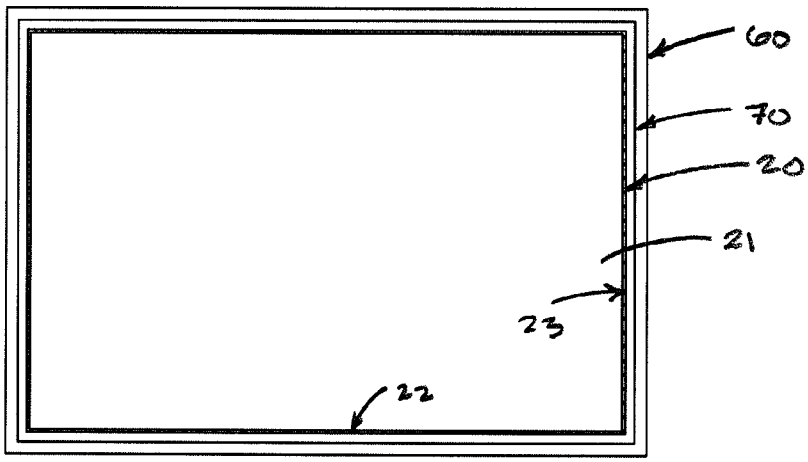
FIG. 13A is a schematic sectional view taken along line A-A in FIG. 13; and, FIG. 14 is another side view showing placement of the cover or shroud over and around the pallet, pallet tray and blocks while preparing the entire assembly for transportation.
Figure 14:
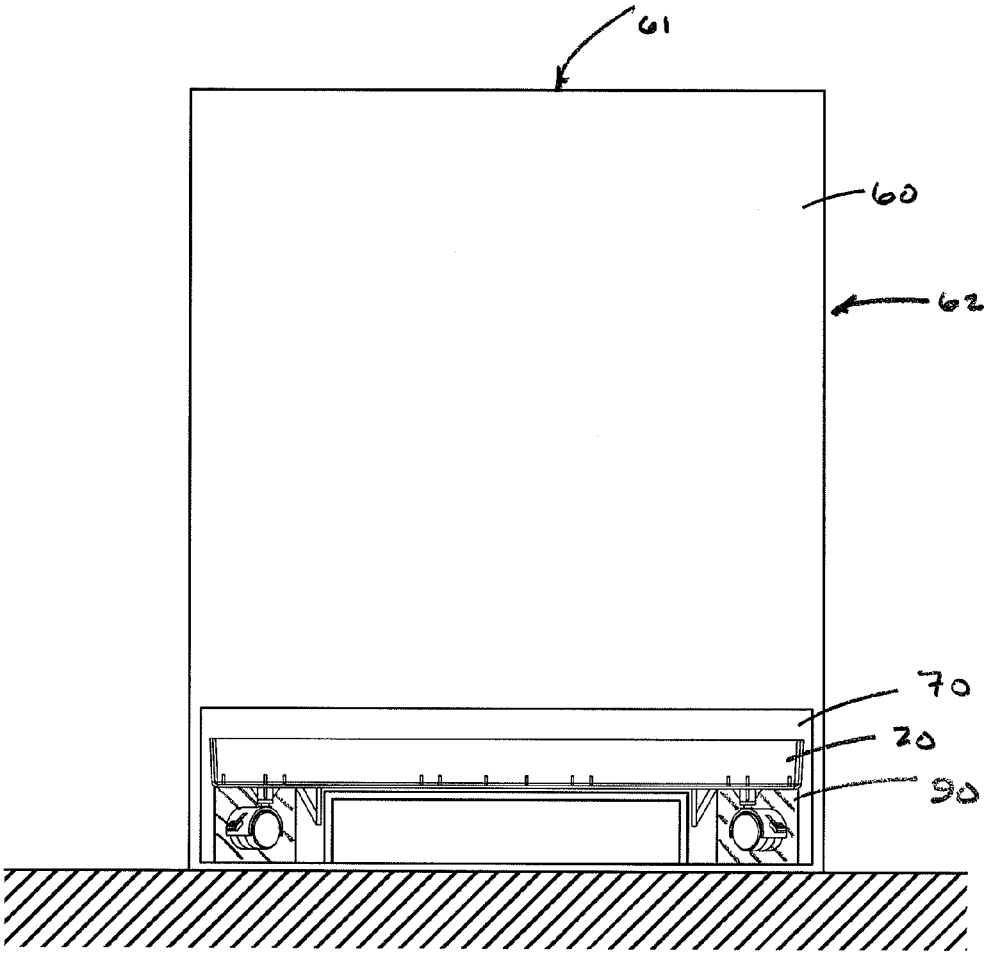

Next, a pair of rectangular blocks 90 (FIG. 1) are placed on the bottom surface 71 of the pallet tray 70 and the pallet 20 is placed on the blocks such that the blocks are generally located between the wheels on the outer side of the guides 33. In FIGS. 12 and 14 the blocks 90 are cross-hatched to highlight their position. These blocks ensure the casters 36 are lifted from the pallet tray 70 and floor 71 thereof. The blocks are preferably made of corrugated materials (paper/cardboard), but can be made of other materials, such as plastic. FIG. 12 shows the distance to be B. In practice, the distance B is about ⅛" (0.125"). This prevents the casters from being damaged during transportation or storage. The side openings 73 in the pallet tray 70 are aligned with the side slot or opening formed between the guides 33 below the bottom surface 21 of the pallet 20.

The display/stacking trays 40A-40E or goods are then placed on the pallet 20. These display trays 40 are common in the industry and typically made of corrugated materials (paper/cardboard), but can be made of other materials, such as plastic, and can be customized, such as for specific promotions. Frequently, the display/stacking trays or goods are restrained by straps, tape or plastic wrapping (not shown).

Once the stacking trays 40 are in place, the cover or shroud 60 is placed around the pallet 20, pallet tray 70, and goods 40. See FIGS. 13 and 14. The cover 60 is open on the bottom. The cover is preferably a corrugated material, such as paper/cardboard, and has a top 61, side walls 62 and opposed notches or openings 63 that align with the opposed side openings 73 in the pallet tray 70 and with the side slot or opening formed between the guides 33 below the bottom surface 21 of the pallet 20. The aligned openings 63 permit the tines of a forklift to move under the pallet and pick-up the entire assembly and to be easily removed. The cover 60 fits snugly around the perimeter of the pallet 20 and pallet tray 70.

A strap or other securing means (not shown) can be used to ensure the entire assembly 10 stays together, covered by the cover/shroud 60, and does not separate when being transported or stored.

The above described pallet and assembly facilitate the moving, storing and displaying of goods, especially goods or products in displays (40). Specifically, once the assembly is assembled, for example, at a warehouse or distribution center, with the goods therein, the assembly can be transported to a desired, remote location, such as at a store. The remote location can store the assembly or move it directly to the floor for displaying to customers. The cover/shroud can be removed, along with any wrappings or straps, and the palletized display/stacking trays or goods directly displayed. Once all the goods are gone, the pallet can be lifted, removed by an individual and reused. The whole process of removing goods or display/stacking trays from the pallet before displaying them is no longer necessary. The goods or display/stacking trays as stacked and packaged in a warehouse or distribution center can be virtually moved to the store floor to consumers.

Note also the pallet 20 acts as a mobile platform. The wheels or casters 36 permit the rolling of the pallet with goods thereon (display trays 40A-40E) to ensure proper position (for storage or display). The size of the tray and wheels permit rolling the assembly in store aisles and freezers. One can also use a forklift (truck or hand-pushed) to pick-up, move and put-down the pallet and goods thereon.

While the specific embodiments have been illustrated and described, numerous modifications are possible without significantly departing from the spirit of the invention, and the scope of protection is only limited by the scope of the accompanying Claims.

I claim:

1. A mobile packaging system including a pallet comprising:

a plastic base having an upper surface and a lower surface;

a perimeter side wall extending upwardly from the upper surface of the base, the perimeter side wall including a first set of opposed parallel end walls extending from a first edge of the base and an opposing second edge of the base, and a second set of opposing end walls extending from a third edge of the base and an opposing fourth edge of the base;

a first plastic guide spaced inwardly from the first edge of the base and integrally formed with and projecting downwardly directly from the lower surface of the base, the first guide having a first generally smooth confronting surface extending substantially from the third edge of the base to the fourth edge of the base, an opposed first outer surface and a plurality of plastic reinforcement ribs extending from the lower surface of the base to the first outer surface, and a second plastic guide spaced inwardly from the second edge of the base and integrally formed with and projecting downwardly directly from the lower surface of the base, the second guide having a second generally smooth confronting surface extending substantially from the third edge of the base to the fourth edge of the base, an opposed second outer surface and a plurality of plastic reinforcement ribs extending from the lower surface of the base to the second outer surface, the first guide and the second guide spaced apart so as to permit forklift tines to pass therebetween and a smooth bottom surface extending between the first generally smooth confronting surface of the first plastic guide and the second generally smooth confronting surface of the second plastic guide, wherein the pallet is rectangular having four corners and a passageway formed between the first generally smooth confronting surface of the first plastic guide and the second generally smooth confronting surface of the second plastic guide and further includes wheels attached adjacent each of the corners with a first wheel and a second wheel being outside of the passageway between the first guide and the first edge of the base and a third wheel and a fourth wheel being outside the passage between the second guide and the second edge of the base, wherein the passageway defines a substantially free space to accommodate transverse movement of the forklift tines; and, a pallet tray with a perimeter tray wall, the pallet tray conforming generally to the perimeter side wall of the pallet, but larger so as to permit the perimeter wall of the pallet to fit in the tray within the perimeter tray wall;

an opening in the perimeter tray wall aligned with the passageway formed between the guides so as to permit one or more forklift tines to pass therethrough.

2. The mobile packaging system of claim 1 further comprising a perimeter channel in the base.

3. The mobile packaging system of claim 1 wherein:

the wheels descend downwardly from the base beyond an imaginary horizontal plane formed by distal ends of the guides to support the pallet on the ground or other support surface.

4. The mobile packaging system of claim 3 wherein:

the base has the upper surface and the lower surface with a plurality of reinforcing ribs projecting upwardly from the upper surface and the lower surface being substantially planar and smooth.

5. The mobile packaging system of claim 1 further including:

blocks disposed between the wheels and the guides of the pallet and on top of the tray; and a display tray held on the upper surface of the base of the pallet within the perimeter side wall.

6. The mobile packaging system of claim 5 further including:

one or more display trays stacked upon the display tray on the base of the pallet and, a cover substantially covering the display trays, pallet, pallet tray and blocks with an opening therein aligned with the opening in the perimeter tray walls and passageway formed between the guides so as to permit one or more forklift tines to pass therethrough.

* * * * *